United States Patent [19]

Kiselev et al.

[11] 4,034,250

[45] July 5, 1977

[54] PLASMATRON

[76] Inventors: Jury Yakovlevich Kiselev, ulitsa Chernomorskaya, 3, kv. 53; Alexandr Mikhailovich Merkher, ulitsa Tolbukhina, 34, kv. 34, both of Kishinev; Stanislav Antonovich Sokolovsky, ulitsa Entuziastov, 27, kv. 85, Kiev, all of U.S.S.R.

[22] Filed: Aug. 16, 1976

[21] Appl. No.: 714,604

[52] U.S. Cl. ..... 313/32; 219/121 P; 313/155; 313/231.5

[51] Int. Cl.[2] ..... H01J 1/50; H01J 7/24; H05H 1/02

[58] Field of Search ..... 313/231.4, 231.5, 155, 313/153, 32; 219/121 P

[56] References Cited

UNITED STATES PATENTS

| | | | |
|---|---|---|---|
| 3,194,941 | 7/1965 | Baird | 313/231.4 X |
| 3,301,995 | 1/1967 | Eschenbach et al. | 313/231.4 X |
| 3,313,980 | 4/1967 | Ducati | 313/155 X |
| 3,953,705 | 4/1976 | Painter | 219/121 P |

*Primary Examiner*—Palmer C. Demeo
*Attorney, Agent, or Firm*—Lackenbach, Lilling & Siegel

[57] ABSTRACT

A plasmatron comprises a casing wherein a water-cooled cylindrical hollow electrode is placed so that its bottom faces the power lead-in and the butt contacts an annular insulating vortex generator which contacts a water-cooled nozzle. The casing also houses a lead-in coil enveloping the cylindrical hollow electrode and positioned with a certain clearance between the electrode and the lead-in coil. One end of the coil is connected to the power lead-in and the other to the butt of the cylindrical hollow electrode.

4 Claims, 4 Drawing Figures

PLASMATRON

This invention relates to plasma arc generators and, in particular, to plasmatrons. The invention can be employed for metal cutting, deposition and coating, surface treatment of metals, as well as in metallurgical and other processes.

Extensively employed in various technological processes are plasmatrons featuring inner rod electrodes made of refractory metals, e.g. tungsten. These plasmatrons can operate when inert or oxygen-free gases are used as plasma-forming gases. Even a medium of oxygen in a plasma-forming gas results in intensive deterioration of such electrodes.

Plasmatrons with zirconium and hafnium cathodes were devised so that oxygen-bearing gases, e.g., air, could be used, being that they are the cheapest and most readily available gases. Such plasmatrons, however, are reliable when operating at low values (usually up 300*a*) of operating currents and can stand a limited number of plasmatron switchings. This is accounted for by the fact that zirconium snd hafnium cathodes are coated in the process of operation by a thin film of their oxides and nitrides, which prevents deterioration of deeper layers. When the plasmatron is switched on and off, this coating is intensively eroded, especially by currents of more than 300*a*.

For plasmatrons operating at high amperage currents and being frequently switched on and off, more reliable are electrodes made of heat-conducting metals, e.g., copper, as hollow cylindrical cups. The arc spot in such plasmatrons tends to travel fast over the inner surface of the electrode thus avoiding its local heating and destruction.

There are known plasmatrons wherein the casing houses a water-cooled cylindrical hollow electrode, its bottom facing the power lead-in and the butt being in contact with an annular insulating vortex generator which is in contact with a water-cooled nozzle.

In the above mentioned plasmatrons current is supplied to the cylindrical hollow electrode by means of a tubular member. The magnetic field induced by the current flowing through said tube has no effect on the arc and cannot make its radial portion and the spot travel over the inner surface of the electrode. In case the arc travels by the vertical gas flow only, the required service life of the plasmatron cannot always be attained, particularly at high amperage and power. Investigations demonstrated that a properly formed gas vortex can keep to specific electrical electrode erosion within 2–5,$10^{-6}$ g/K. A two- or five-fold drop in erosion can be achieved by introducing an outer magnetic field resulting in travelling of the arc spot over the surface of the electrode, which is matched with the vortex movement. However, outer magnetic fields are obtained by the use of inductance coils which require additional power sources, thus increasing the plasmatron dimensions. Moreover, their employment cannot ensure an increase of the magnetomotive force proportional to the increase of the operational current and it makes electrical insulation of the operational current circuits from the coils supply circuits complicated, which finally reduces the reliability of the plasmatron.

The object of this invention is to provide a plasmatrom. wherein the arc spot travels over the inner surface of the cylindrical hollow electrode by the combined effort of the gas vortex and the magnetic field induced by the operational current of the arc.

Another object of the invention is to provide a plasmatron wherein the magnetomotive force is increased proportional to the value of the operational current so that the service life of the electrode is increased two- to five-fold and the reliablity of the plasmatron is ensured.

Another object of this invention is to provide a plasmatron wherein a better system of water-cooling of the outer surface of the cylindrical hollow electrode is provided.

This is achieved by a plasmatron, wherein the casing houses a water-cooled cylindrical hollow electrode, its bottom facing a power lead-in and its butt being in contact with an annular insulating vortex generator which is in contact with a water-cooled nozzle, according to the invention, there is provided a coil enveloping the cylindrical hollow electrode and positioned with a certain clearance between the electrode and the coil, one end being connected to the lead-in and the other end being connected to the butt of the cylindrical hollow electrode.

It is advisable that the loops of the lead-in coil have uniform pitch.

It is advisable that the end of the lead-in coil is connected to the butt of the cylindrical hollow electrode by means of a support ring featuring lugs directed to the butt of the electrode and being in contact therewith.

Owing to such design the plasmatron has a longer service life, higher power and an increased efficiency.

These and other objects of this invention will become apparent below when dealing with concrete embodiments of the invention and the accompanying drawings, wherein.

Figure 1:
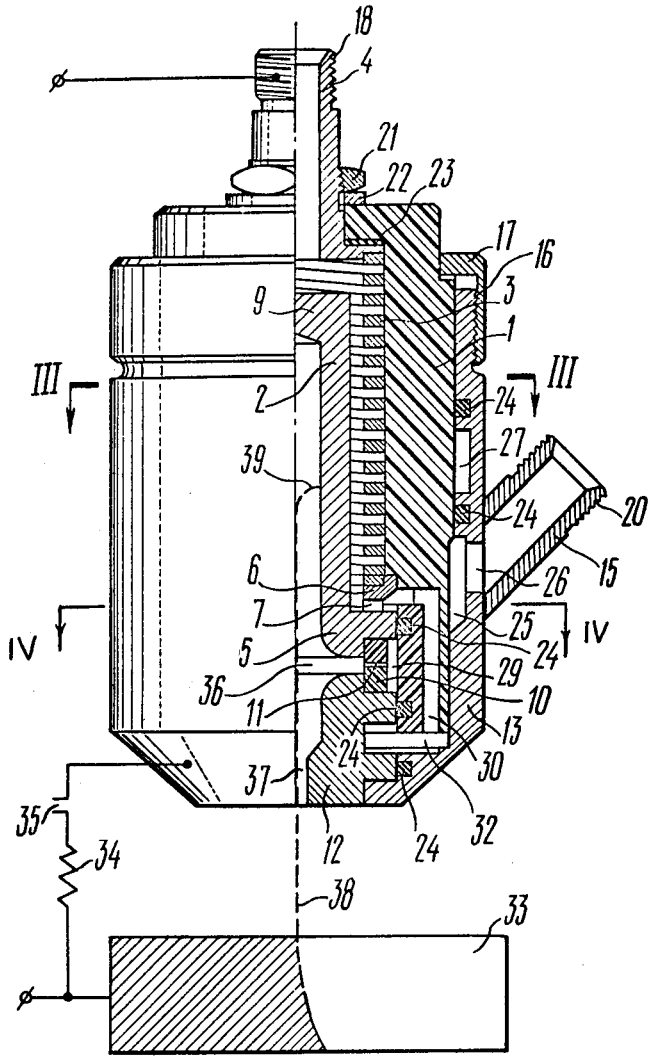
FIG. 1 is a general view, partially broken away and in section, of the plasmatron, according to the invention.

The plasmatron, according to the invention, will be described in the embodiment intended for metal cutting.

A plasmatron comprises, according to the invention, a casing 1 (FIG. 1) made of an insulating material. The casing 1 houses a water-cooled cylindrical hollow electrode 2, a lead-in coil 3 and a power lead-in made as a lead-in pipe connection 4.

The lead-in coil 3 envelops the cylindrical hollow electrode 2, one end being connected to the lead-in pipe connection 4 and the other end being connected to a butt 5 of the cylindrical hollow electrode 2 by means of a support ring 6 featuring lugs 7 (FIG. 2) directed towards the butt 5 (FIG. 1) and being in contact thereto. A clearance 8 (FIG. 3) is provided between the outer surface of the electrode 2 and the lead-in coil 3.

The loops of the lead-in coil 3 (FIG. 1) have uniform pitch which provides for better cooling of the electrode 2 and for a maximum value of the magnetomotive force. However, the loops of the lead-in coil may be non-uniform in pitch to shape a certain profile of the magnetic field.

The cylindrical hollow electrode 2 has a bottom 9 facing the lead-in pipe connection 4 and positioned at a certain distance therefrom. The butt 5 of the electrode 2 is in contact with an annular vortex generator 10 made of an insulating material and having six passages 11 tangential to the inner annular surface. The annular vortex generator 10 contacts a water cooled nozzle 12.

Figure 3:
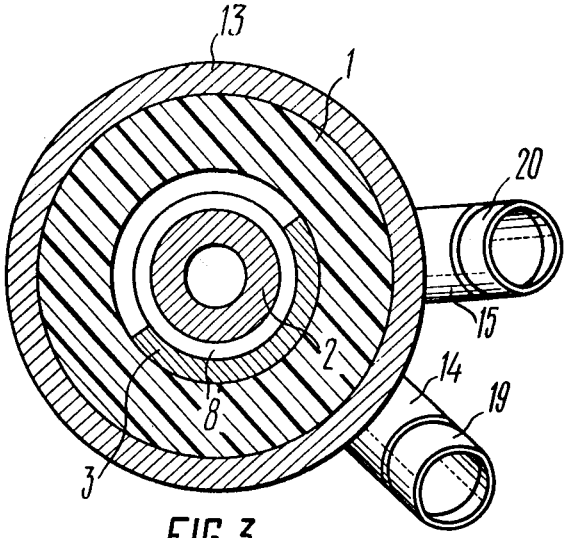
FIG. 3 is a cross-sectional view taken along line III—III of FIG. 1.

The casing 1 is housed within a metal cover 13 protecting it against mechanical damage. A pipe connection 14 for air supply and a pipe connection 15 for a cooling water outlet are welded to the cover 13 (FIG. 3).

The cover 13 (FIG. 1) is provided with a thread 16 at its upper portion for a nut 17 to be screwed thereon. The lead-in pipe connection 4 and the pipe connections 14 and 15 (FIG. 3) are provided with threads 18,19 and 20 (FIG. 3) correspondingly to join pipes (not shown) for supply of water and air and removal of the cooling water.

The lead-in pipe connection 4 (FIG. 1) is secured in the casing 1 by means of a nut 21 and a washer 22.

Water and air conduits of the plasmatron are sealed by means of packings 23 and 24.

A space 25 is provided in the cover 13 to hold the cooling water and it is connected by an opening 26 to the water outlet pipe connection 15. There is also an air space 27 connected by an opening (not shown) to the compressed air supply pipe connection 14 (FIG. 3).

Figure 4:
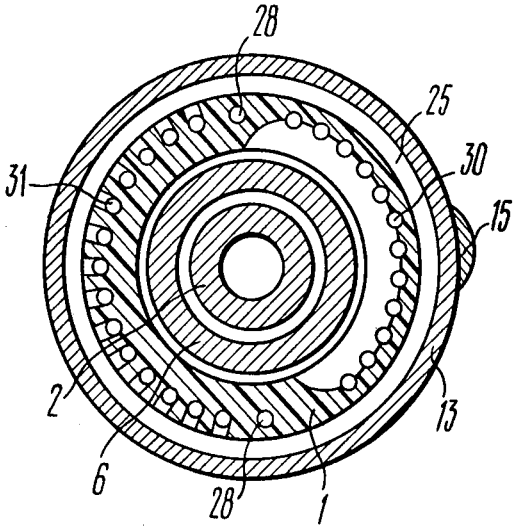
FIG. 4 is a cross-sectional view taken along line IV—IV of FIG. 1.

The casing 1 (FIG. 4) has two openings 28 for air supply connecting the container 27 (FIG. 1) to a space 29 and openings 30 and 31 (FIG. 4) to pass the cooling water. The openings 30 (FIG. 1) in the upper part of the casing 1 are provided with outlets inside said casing, whereas the openings 31 (FIG. 3) are provided with outlets outside the casing 1 in front of the space 25 in the cover 13. The openings 30 (FIG. 1) and 31 (FIG. 4) in the bottom part of the casing 1 (FIG. 1) are connected to a space 32 for cooling the nozzle 12.

One pole of a power source (not shown) is connected to the lead-in pipe connection 4 and the other pole is connected to a workpiece 33 and at the same time through a ballast resistance 34 and a contactor 35 to the cover 13 and the nozzle 12 which is in electrical contact therewith.

The proposed plasmatron operates as follows.

Running water is supplied by means of a pipe (not shown) to the lead-in pipe connection 4 for the purpose of cooling the cylindrical hollow electrode 2 (FIG. 1) and the nozzle 12. The cooling water passes in the clearance 8 (FIG. 3) between the cylindrical hollow electrode 2 and the lead-in coil 3 as well as between the loops of the lead-in coil 3 (FIG. 1), the electrode 2 being thus intensively cooled. After cooling the electrode 2 the water passes between the lugs 7 (FIG. 2) of the support ring 6 through the openings 30 (FIG. 1) of the casing 1 into the cooling space 32 of the nozzle 12, the water passes through the openings 31 (FIG. 4) in the casing 1 flows into the space 25 in the cover 13 and is removed by means of the pipe connection 15 (FIG. 1) and a pipe (not shown) from the plasmatron.

Figure 2:
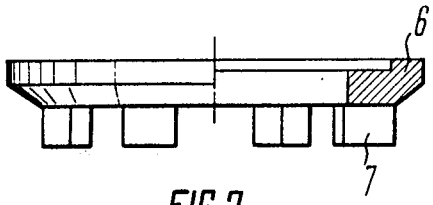
FIG. 2 is a general view, partially broken away, of a support ring with lugs, according to the invention.

Then compressed air (usually at $p = 2$–$4$ atm) is supplied by a pipe (not shown) to the pipe connection 14 (FIG. 3). The air passes from the pipe connection 14 through the space 27 (FIG. 1) of the cover 13 and the openings 28 (FIG. 4) of the casing 1 into the space 29 (FIG. 1). The compressed air comes through the tangential passages 11 of the vortex generator 10 out into the clearance 36 between the electrode 2 and the nozzle 12. A vortical air flow is formed in this clearance 36 and then flows out over the inner surface of the cylindrical hollow electrode 2 along its full vertical extent and comes out of nozzle outlet 37 (usually 3–5 mm in diameter) and leaves the plasmatron.

After that, a no-load voltage from the supply source (not shown) is fed to the lead-in pipe connection 4 and to the metal workpiece 33 and, consequently, through the ballast resistance 34 and the closed contactor 35. An initiating device (not shown) generates a high-voltage pulse (usually also high-frequency) fed to the clearance 36 between the electrode 2 and the nozzle 12, which causes the electrical break-down of said clearance 36 and forms an ionized channel. A low-intensity (usually up to 30–100*a*) initiating arc is established in this channel.

The electric current flows along this circuit: supply source, the lead-in pipe connection 4, the lead-in coil 3, the cylindrical hollow electrode 2, the nozzle 12, the cover 13, the contactor 35, the ballast resistance 34, and the supply source. The low-intensity initiating arc is pushed out of the clearance 36 between the butt 5 of the cylindrical hollow electrode 2 and the nozzle 12 by the force of the vortical air flow and is stretched throughout the entire length of the electrode 2 and the nozzle 12 and is stabilized along their axis. The low-intensity initiating arc is also stabilized along the axis of the cylindrical hollow electrode 2 by the magnetic flux of the lead-in coil 3.

As soon as the plasma flow of the low-intensity initiating arc coming out of the nozzle 12 touches the metal work-piece 33, an operating-power arc 38 is established extending from the cylindrical hollow electrode 2 and the workpiece 33 cuts it as the plasmatron is moved.

The circuit of the electric current in this case is as follows: the supply source, the lead-in pipe connection 4, the lead-in coil 3, the cylindrical hollow electrode 2, the workpiece 33, and the supply source. When the operational arc 38 is established, the electrical connection between the workpiece 33 and the nozzle 12 is broken by means of the contactor 35.

A spot 39 of the arc 38 travels inside the cylindrical hollow electrode 2 under the action of the vortical air flow and rotates intensively about its inner surface. Since the lead-in coil 3 is connected to the butt 5 of the electrode 2 and envelops it, the electrodynamic force thus produced also contributes to moving the spot 39 of the arc 38 along the inner surface of the electrode 2. This force increases proportionally to the increase of the operating current because it successively flows through the lead-in pipe connection 4, the lead-in coil 3 and the cylindrical hollow electrode 2. Circular travelling of the arc spot 39 combined with its vertical movements at the expense of two forces is particularly important when the plasmatron is operated at a high-power duty up to 120–150 kwt.

Circulation of the cooling water around the outer surface of the cylindrical hollow electrode and the lead-in coil produces effective cooling for a wide range of operating powers of the plasmatron.

The proposed plasmatron ensures establishment of a plasma arc with any gases, including oxygen-bearing ones. It does not require any specific or expensive materials to manufacture it. The cylindrical hollow electrode and the nozzle may be made from regular copper. The plasmatron can be taken apart completely and any detail is easy to change. Employment of a lead-in coil enveloping the electrode permits more intensive travel of the arc spot along the inner surface of the cylindrical hollow electrode, and water-cooling of its outer surface makes the service life of the plasmatron 2–5 time longer. When it is used for air-plasma cutting of metals, the efficiency of labor is 1.5–2 times higher and the operational period of the electrode is up to 20–40 hours. The claimed plasmatron is particularly effective when technological conditions require frequent switchings and high-power operation.

In the description of the preferred embodiment of the invention specific narrow terminology is resorted to for the sake of clarity. However, this invention is in no way limited to the terminology thus adopted and it should be remembered that each such term is used to denote all equivalent elements functioning in an analogous way and employed for similar purposes.

Though a preferred embodiment of this invention has been shown and described, various modifications and variations may be made without deviating from the scope and spirit of this invention which is clear to those skilled in the art.

These modifications and variants do not constitute departures from the spirit and scope of the invention as set forth in the appended claims.

What is claimed is:

1. A plasmatron comprising:

a casing having a first butt and a second butt;

a power lead-in positioned in the first butt of said casing;

a cylindrical hollow electrode positioned in said casing at a certain distance from said lead-in and having a bottom facing said lead-in and a butt end;

a lead-in coil having a first end and a second end and enveloping said cylindrical hollow electrode and positioned with a clearance between said electrode and said coil, the first end of said coil being connected to said lead-in and the second end being connected to said butt of said cylindrical hollow electrode;

an annular vortex generator made of insulating material positioned in said casing along its periphery and having a first butt and a second butt and at least one passage tangential to the inner annular surface of said vortex generator, the first butt being in contact with said butt of said electrode;

a nozzle positioned in the second butt of said casing and being in contact with the second butt of said annular vortex generator;

a means of supplying cooling water into said clearance between said electrode and said coil, to said nozzle and of removing said water therefrom;

a means of supplying air through said passage of said vortex generator into the space of said electrode;

a means of supplying said electrode and said nozzle with electricity.

2. A plasmatron as claimed in claim 1 comprising a support ring having a butt and lugs, said butt of said support ring being in contact with said second end of said coil and said lugs being in contact with said nozzle.

3. A plasmatron as claimed in claim 1 wherein the loops of said coil are uniform in pitch.

4. A plasmatron as claimed in claim 3 comprising a support ring having a butt and lugs, said butt of said ring being in contact with said second end of said coil and said lugs being in contact with said nozzle.

* * * * *